US006247991B1

(12) United States Patent
Chen

(10) Patent No.: US 6,247,991 B1
(45) Date of Patent: Jun. 19, 2001

(54) DYNAMIC COLLAPSIBLE ROTATING TOY

(76) Inventor: Kun-Yueh Chen, No. 18, Alley 7, Lane 39, Kuo-Tai Street, Panchiao City, Taipei Hsien (TW)

( * ) Notice: Subject to any disclaimer, the term of this patent is extended or adjusted under 35 U.S.C. 154(b) by 0 days.

(21) Appl. No.: 09/488,523

(22) Filed: Jan. 21, 2000

(51) Int. Cl.[7] ..... A63H 1/24; A63H 1/28; B09F 15/00

(52) U.S. Cl. ..... 446/242; 40/610; 74/89.22; 403/109.7

(58) Field of Search ..... 446/242; 40/610, 40/470, 538, 540, 463, 466; 74/89.22; 403/109.7, 109.1

(56) References Cited

U.S. PATENT DOCUMENTS 2,070,669 * 2/1937 Luthi .
2,663,285 * 12/1953 Johnston .
2,841,901 * 7/1958 Maple .
3,919,794 * 11/1975 Hunter, Jr. ..... 40/30

* cited by examiner

*Primary Examiner*—Jacob K. Ackun, Jr.
*Assistant Examiner*—Bena B. Miller
(74) *Attorney, Agent, or Firm*—Rabin & Champagne, P.C.

(57) ABSTRACT

A dynamic collapsible and revolving toy, comprising an interior sleeve set and an exterior sleeve set that are installed at the center inside a base, said interior sleeve set involves a winding strip and driven by a piece of extension/retraction driving motor, the exterior sleeve set covers the outside of the interior sleeve set, which innermost sleeve is linked to the innermost sleeve of the interior sleeve set, and is able of extending/retracting functions when driven by the extension/retraction driving motor, on the upper rim of each sleeve of the exterior sleeve set are inserted a decorative article suited to the theme of the toy, to the base of the outermost sleeve is linked a gear which is toothed with and driven by a rotation driving motor, when the user turns on the power switch on one side of the base, the extension/retraction driving motor is started to drive a winding strip to push out the interior and exterior sleeve sets from the base, so they are erected right above the base, then the gear on the base of the exterior sleeve set touches and activates a first micro switch located on one side of the sleeve set, thereby activating the rotation driving motor, so on one hand, it controls a reduction gear to drive the exterior sleeve set to rotate slowly, while on the other hand, it drives the control circuit installed inside the base to play melodious music and flash the LED lamps hanging on the decorative article, when the user turns on another operating switch, it will turn off the music and LED, and drive the extension/retraction driving motor to turn in a reverse direction, then the extended interior and exterior sleeve sets will be retracted into the base, until after the gear on the base of the exterior sleeve set touches another second micro switch, it will automatically cut off power and restore to its idle status, so the operation is quite easy and convenient and the movement is fun and smooth, giving much fun and novelty to the theme of the toy.

6 Claims, 3 Drawing Sheets

DYNAMIC COLLAPSIBLE ROTATING TOY

BACKGROUND OF THE INVENTION

The subject invention relates to a dynamic collapsible rotating toy, particularly to one that is full of fun and amusement, involving an interior sleeve set and an exterior sleeve set that are installed inside a base. The outside of the exterior sleeve set is inserted with decorative articles to suit the theme. An extension/retraction driving motor and a rotation driving motor are installed in the base to extend the interior and exterior sleeve sets out of the base, and to slowly rotate the interior sleeve sets and the exterior sleeve sets as well as the decorative articles hanging thereon by activating micro switches, and start the music and flash the lights. During the activated processes, optical control or voice control can be effected to change the status of rotation or turn on or off the music or lights, and by pressing the switch, the interior and exterior sleeve sets can be retracted inside the base and restored to their idle status.

Along with the advancement of technology and transportation, and more frequent exchanges of folk customs between countries, many festivals and occasions have become holidays to be shared and celebrated by many countries, such as Christmas, the Valentine's Day, Mother's Day, etc. To celebrate such occasions, various toys and gifts would be put on the market, which are bought by consumers to send to their friends to express their friendship, respect or love. The variety of gifts and toys on the market can be as wide as you think. But most of them are for static display and viewing enjoyment. We see very little dynamic toys and gifts. Consumers would find it difficult, if not impossible, to find an amusing dynamic toy.

In view of the above, the subject inventor has dedicated in the research, based on many years of rich experiences in the R&D and production of various toys and gifts. After repeated processes in drawing, test production, tests and amendments, the present inventor has finally come up with a "dynamic, collapsible, rotating toy" that is full of fun and amusement, that can be extended or retracted, rotate, play music and flash lights.

To enable a better understanding of the configuration, characteristics and performance of the subject invention, the following drawings are explained in details:

BRIEF DESCRIPTION OF NUMERALS

Figure 1:
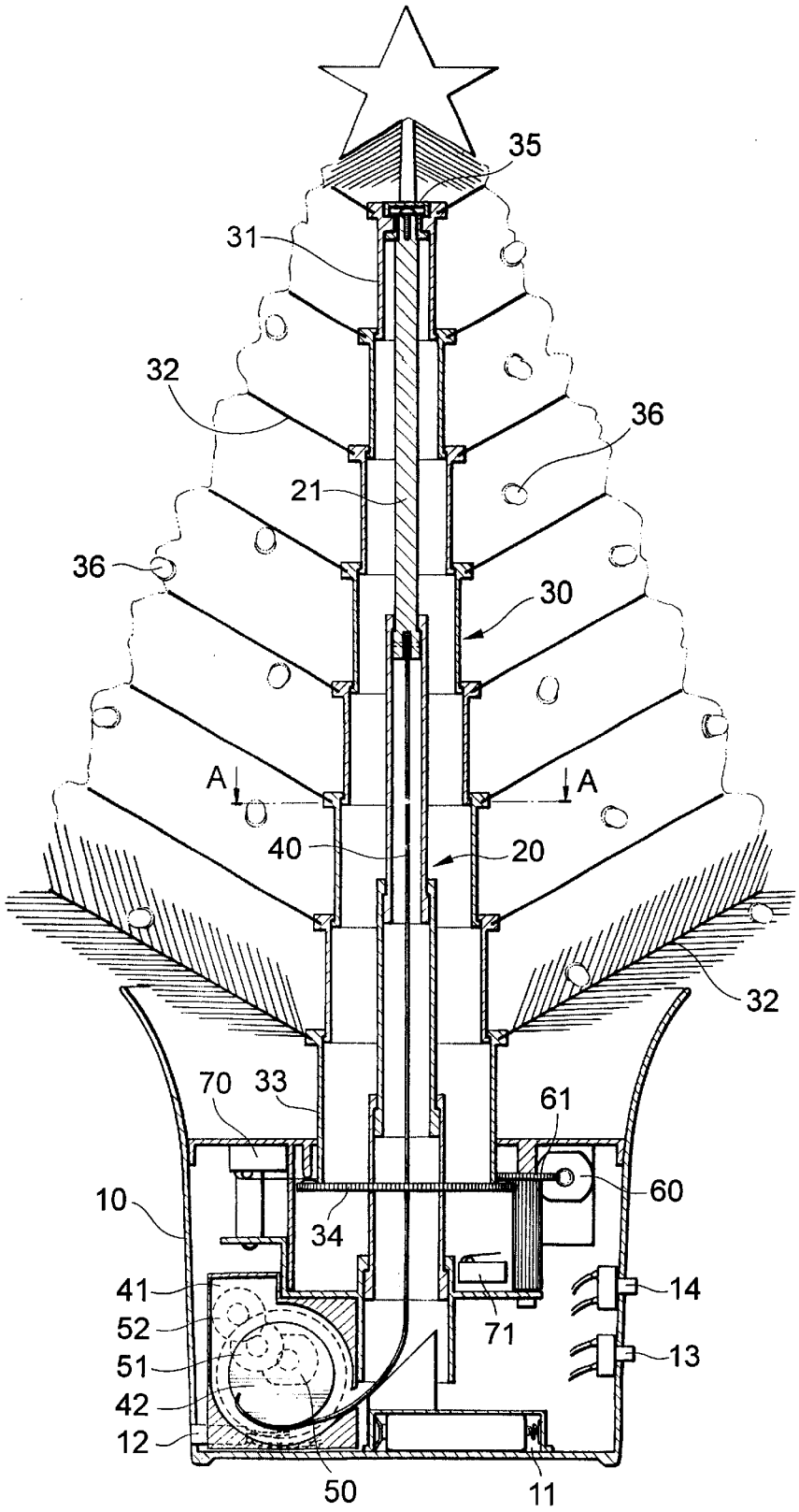
FIG. 1 is a section view of the invention as it is extended.

10 base
11 battery compartment
12 exterior power socket
13 power switch
14 operating switch
20 interior sleeve set
21 innermost sleeve
30 exterior sleeve set
31 innermost sleeve
32 decorative article
36 LED
37 protruded block

40 winding strip
41 take-up box
42 winding shaft
50 extension/retraction driving motor
51 reduction gear
52 reduction gear
60 rotation driving motor
61 reduction gear
33 outermost sleeve
34 gear
35 top cover
70 first micro switch
71 second micro switch

DETAILED DESCRIPTION OF PREFERRED EMBODIMENT

Referring to FIG. 1, the subject invention is configured as follows: at the center, inside of a base 10 are installed an interior sleeve set 20 and an exterior sleeve set 30. The interior sleeve set 20 is composed of a specified number of tube sleeves of smaller diameters that are interlinked one by one, of which the innermost tube 21 is linked to one end of a scroll 40 that is made of flexible thin metal, while the other end of the scroll 40 is wound on a winding shaft 42 inside the take-up box 41 on the inside of the base 10. The concentric outside of the interior sleeve set 20 is covered by the exterior sleeve set 30. The exterior sleeve set 30 is composed of a specified number of tube sleeves of larger diameter that are interlinked one by one, which innermost sleeve 31 is linked to the innermost sleeve 21 of the interior sleeve set 20, to allow the exterior sleeve set 30 to extend or retract along with the interior sleeve set 20. On the upper edge of each sleeve of the exterior sleeve set 30 may be inserted a decorative article 32 (since the subject of the preferred embodiment is an extendable and revolving Christmas tree toy, the decorative article 32 refers to Christmas tree leaves) to suit the theme of the toy. On the base of the outermost sleeve 33 is a gear 34. Fixed on the side of the take-up box 41 is a driving motor 50 to control extension and retraction functions. The driving motor 50 serves to drive the winding shaft 42 inside the take-up box 41 through reduction gears 51, 52. On the other side within the base 10 is fixed a driving motor 60 to control rotation function. The driving motor 60 serves to drive the gear 34 on the base of the exterior sleeve set 30 through a reduction gear 61. On one side of the upper vertex of displacement of the gear 34 is a first micro switch 70. On one side of the lower vertex of displacement of said gear 34 is a second micro switch 71. On other positions of the base 10 are installed a battery seat 11, an exterior power socket 12, a power switch 13 and an operating switch 14. The top of the exterior sleeve set 30 can be covered by a decorative hood 35. On the exterior of the decorative article 32 can be the decoration of several pieces of LED 36.

Figure 3:
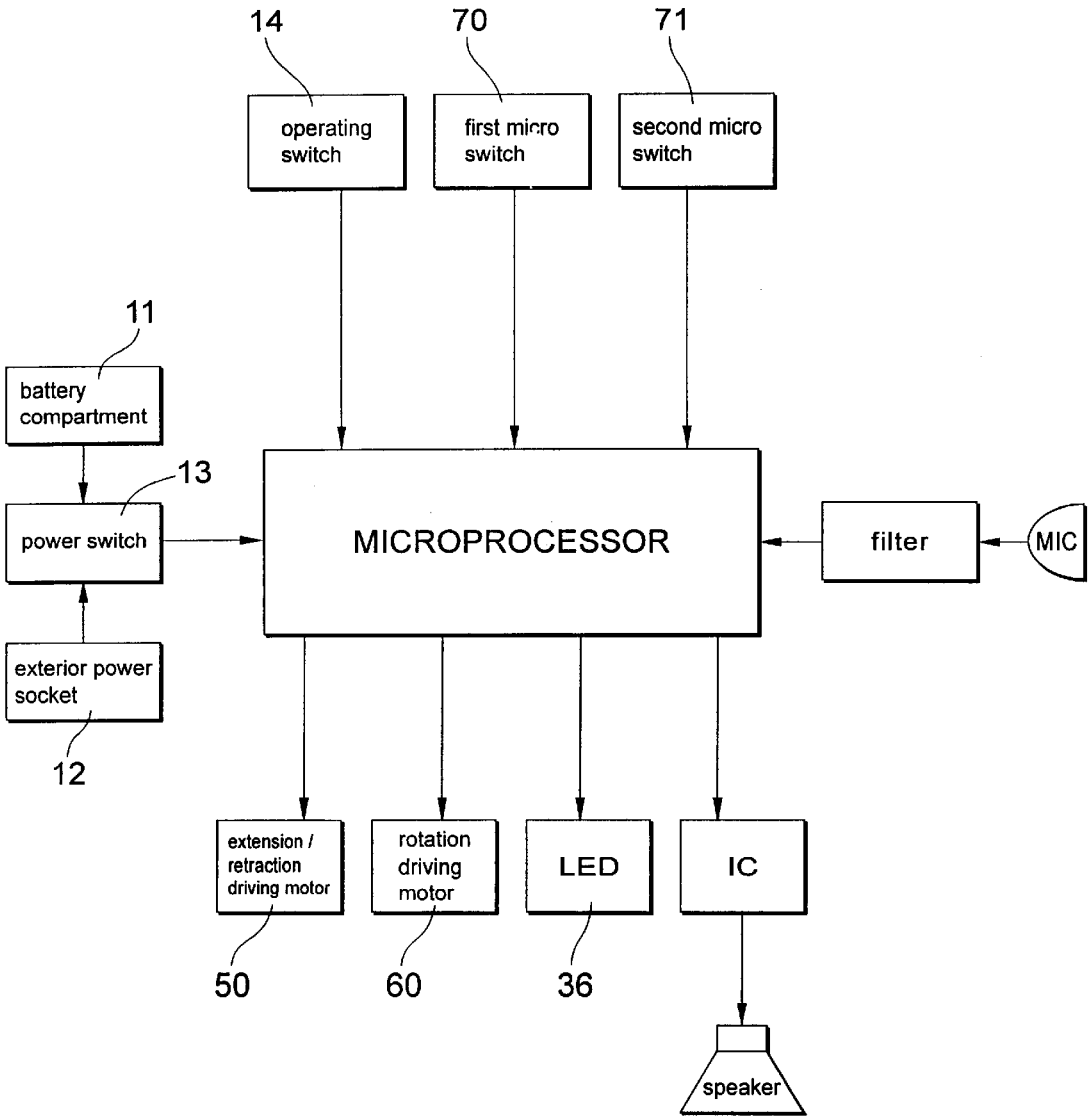
FIG. 3 is a wiring diagram of the invention.

All component driving mechanisms of the invention are controlled by a control circuit installed inside the base 10. As shown in FIG. 3, the control circuit includes a drive circuit to control the driving motor 50 in extension and retraction functions and the driving motor in revolving function, to light on and off the lighting emitted by the LED 36 outside the decorative article 32, and a music circuit that contains an IC of several pieces of melodic music.

Figure 2:
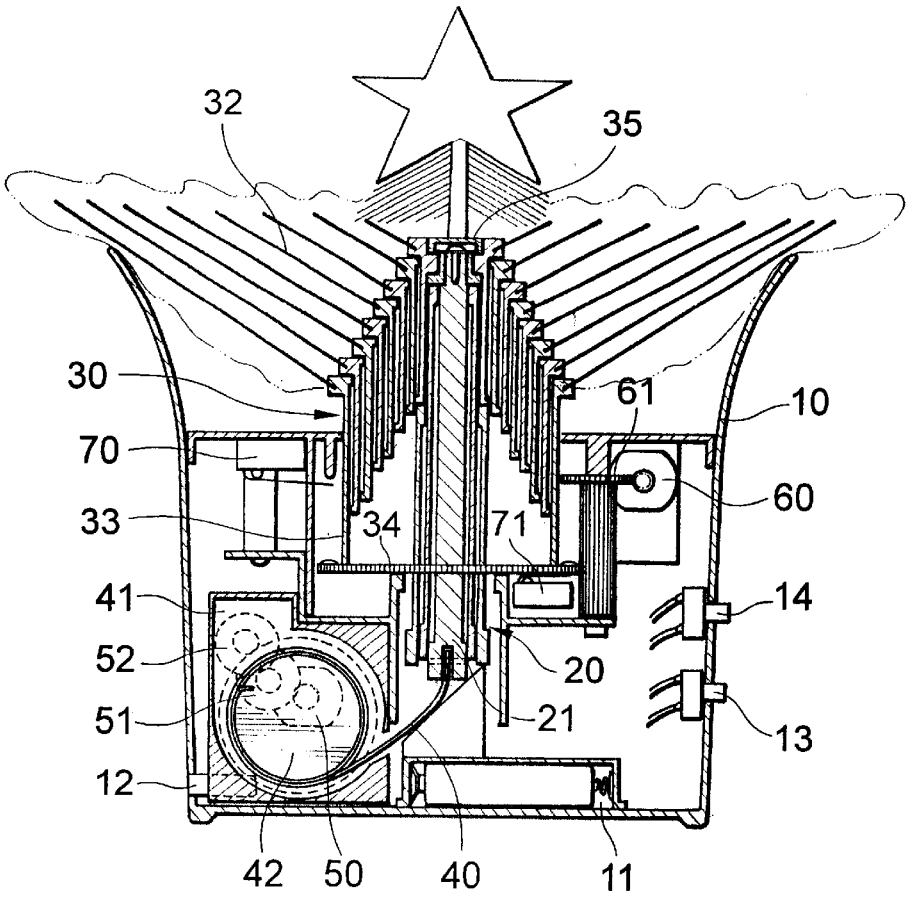
FIG. 2 is a section view of the invention as it is collapsed.
Figure 4:
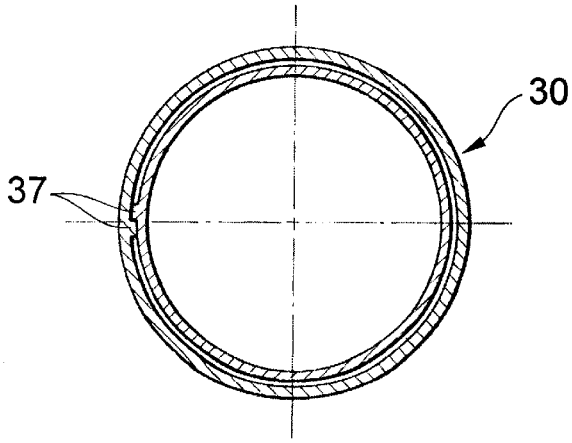
FIG. 4 is a section view of the exterior sleeve assembly in the invention as it is sectioned along the line A—A in FIG. 1.

In actual application of the abovementioned configuration of the invention, power can be supplied by inserting a battery in the battery compartment 11, or by connecting a power transformer to the exterior power socket 12. As shown in FIG. 2, before operating, all sleeves of the interior and exterior sleeves 20, 30 are retracted and hidden inside the base 10. In this preferred embodiment, it shows an amusing image of a Christmas tree hidden in a flower pot (in other words, the base 10). When the user turns on the power switch 13, the driving motor 50 is started to transmit a driving force through reduction gears 51, 52 to slowly drive the winding shaft 42 inside the take-up box 41, pushing up the winding strip 40 on the winding shaft 42. The driving of the winding strip 40 slowly elevates the interior and exterior sleeve sets 20, 30, so in the eyes of an observer, a Christmas tree is slowly rising from inside a flower pot. When the interior and exterior sleeve sets 20, 30 have risen to the top, the gear 34 on the base of the exterior sleeve set 30 will touch the first micro switch 70 (as shown in FIG. 1); then the first micro switch 70 will activate the drive circuit, lighting circuit and music circuit in the control unit. Then the revolving drive motor 60 is started to transmit a driving force through the reduction gear 61 to slowly rotate the gear 34. Since the gear 34 is linked to the outermost sleeve 33 in the exterior sleeve set 30, and all sleeves of the exterior sleeve set 30 are inter-driven by the protruded blocks 37 between them (refer to FIG. 4), the whole exterior sleeve set 30 (along with the decorative article 32) will be driven to rotate slowly. On the other hand, the lighting circuit will drive all LED's 36 installed on the outside of the decorative article 32 to flash on and off, and the music circuit will drive the built-in speaker to give melodious music, so we can see the Christmas tree slowly revolving to the music. The LED 36 lamps hanging on the tree will flash on and off to create an atmosphere of a merry Christmas. When the user wishes to turn off the above operation functions, the operating switch 14 can be pressed to activate the control circuit and stop the rotation driving motor. The LED 36 and the music will be turned off, and the extension driving motor 50 will rotate in a reverse direction. In the same way, the reduction gears 51, 52 will drive the winding strip 40 to retract, then the winding strip 40 will drive the interior and exterior sleeve sets 20, 30 to drop until all the sleeves are retrieved inside the base 10. Then the gear 34 will touch the second micro switch 71, and the power will be turned off. At this stage, the entire Christmas tree will be hidden in a static condition within the flower pot. The entire operational process is quite easy and convenient, and the driving mechanism of all components of the invention is operated smoothly. All the user has to do is to turn on the power switch 13 and the operating switch 14, then the invention will be activated to rise and fall, revolve, flash on light and play melodious music. Moreover, optical control or sound control switches can be added in the control circuit of the invention, so that when the interior and exterior sleeve sets 20, 30 rise and lamps light on with music playing, the lamps or music can be switched off simultaneously or separately by the passage of someone walking in front of the invention or clapping his hands which activates the optical control or sound switch, thereby adding much fin to the toy. Furthermore, without changing its basic construction, the exterior styling of the invention can be properly modified or revised to have styling representation of different themes. For example, the exterior sleeve set 30 can be decorated as a multi-layered cake, and the base 10 can be remodeled as a cake box. Then the invention can be used as a birthday present. Alternatively, the exterior sleeve set 30 can be decorated to show an image of a retractable Paris Eiffel Tower. Then the invention will become a dynamic decorative item presenting multiple themes with excellent application.

Summing up, the invention has employed a delicately designed and innovated construction, with variation of multiple combinations of exterior styling configuration to suit different themes (such as Christmas, Valentine's Day, birthday, etc.) or it may serve as a dynamic toy for display or observation purposes, involving such dynamic effects as collapsibility, rotation, flashing light and melodious music, etc., thus creating an atmosphere of merriness and warmth on special occasions, and enhancing better human relations.

What is claimed is:

1. A dynamic collapsible revolving toy, comprising:

a base;

a take-up box within said base;

a winding shaft disposed within said take-up box;

a winding strip comprised of a flexible, thin material having one end wound on said winding shaft;

an interior sleeve set disposed essentially at a center of said base, said interior sleeve set including a plurality of nesting tube sleeves interlinked together, an innermost one of said nesting tube sleeves being linked to another end of said winding strip;

an exterior sleeve set concentrically disposed around said interior sleeve set so as to cover said interior sleeve set, said exterior sleeve set including a plurality of nesting tube sleeves interlinked together, an innermost one of said nesting tube sleeves of said exterior sleeve set being linked to said innermost one of said nesting tube sleeves of said interior sleeve set, so that said interior sleeve set and said exterior sleeve set are collapsible and extendible together, each one of said nesting tube sleeves of said exterior sleeve set having a rim on a top portion thereof, said rims being adapted to receive a decorative article, each said nesting tube sleeve of said exterior sleeve set further having a protruding block that engages with a protruding block of an adjacent nesting tube sleeve of said exterior sleeve set, so that adjacent ones of said nesting tube sleeves of said exterior sleeve set are interdriven to rotate;

a gear attached to a base of an outermost one of said nesting tube sleeves of said exterior sleeve set, said gear being vertically displaceable to upper and lower vertexes of displacement;

a first driving motor attached to said take-up box and transmitting a driving force to drive said winding shaft and cause said exterior sleeve set and said interior sleeve set to extend and retract via said winding strip;

a second driving motor attached to an inside of said base, said second driving motor transmitting a driving force to drive and rotate said gear, thereby causing said exterior sleeve set to rotate;

a first micro switch activatable when said gear is displaced to the upper vertex of displacement;

a second micro switch activatable when said gear is displaced to the lower vertex of displacement; and a control circuit disposed in said base, said control circuit including drive circuits to control the first and second driving motors in dependence on an activation or deactivation of said first and second micro switches.

2. The toy recited in claim 1, wherein said control circuit includes a music circuit for playing music.

3. The toy recited in claim 1, further comprising a battery seat, an exterior power socket, a power switch and an operating switch disposed on said base.

4. The toy recited in claim 1, further comprising a hood covering a top of said exterior sleeve set.

5. The toy recited in claim 1, wherein the decorative article includes a plurality of LED lamps.

6. The toy recited in claim 5, wherein said control circuit includes a lighting circuit that controls a flashing of the LED lamps.

* * * * *